US006321874B1

(12) United States Patent
Miyamoto

(10) Patent No.: US 6,321,874 B1
(45) Date of Patent: Nov. 27, 2001

(54) DEVICE FOR REMOVING LUBRICATING OIL FROM AN ENGINE

(76) Inventor: Hisao Miyamoto, Kuo, Tamatsukuri-machi, Namegata-gun, Ibaraki-ken (JP)

( * ) Notice: Subject to any disclaimer, the term of this patent is extended or adjusted under 35 U.S.C. 154(b) by 0 days.

(21) Appl. No.: 09/461,456

(22) Filed: Dec. 14, 1999

(51) Int. Cl.[7] ..... F04F 3/00
(52) U.S. Cl. ..... 184/1.5; 137/205; 184/108
(58) Field of Search ..... 137/205; 184/1.5, 184/108

(56) References Cited

U.S. PATENT DOCUMENTS

| | | | | |
|---|---|---|---|---|
| 820,922 | * | 5/1906 | Einsele | 116/276 |
| 2,020,350 | * | 11/1935 | Bertschinger | 184/1.5 |
| 2,536,492 | * | 1/1951 | Dunn et al. | 137/205 |
| 2,682,886 | * | 7/1954 | Paxton | 137/205 |
| 2,740,420 | * | 4/1956 | Hanks | 137/205 |
| 3,095,062 | * | 6/1963 | Neely | 184/1.5 |
| 3,272,535 | * | 9/1966 | Neely | 184/1.5 |
| 4,354,574 | * | 10/1982 | Kieber | 137/205 X |
| 4,378,026 | * | 3/1983 | Bauer | 137/205 |
| 4,807,674 | * | 2/1989 | Sweet | 137/205 X |
| 5,492,144 | * | 2/1996 | Kriewaldt | 137/205 |
| 5,772,402 | * | 6/1998 | Goodman | 137/205 X |

* cited by examiner

*Primary Examiner*—Gerald A. Michalsky
(74) *Attorney, Agent, or Firm*—Jordan and Hamburg LLP

(57) ABSTRACT

A device having an extraction pipe that can be inserted into the bottom of the oil pan through the opening of the oil level dipstick tube of the engine until the end of the extraction pipe contacts the bottom of the oil pan. The lubricating oil in the oil pan is extracted by the suction pump of the device and is deposited into the reservoir via the pipe. The device of the present invention can remove the oil safely without splashing high temperature lubricating oil on the operator. Moreover, it can prevent the problems that occur when oil leaks out, when a person forgets to screw in the oil plug, or when a person damages the seal of the oil drain plug by tightening the drain plug too tight.

3 Claims, 18 Drawing Sheets

DEVICE FOR REMOVING LUBRICATING OIL FROM AN ENGINE

BACKGROUND OF THE INVENTION

This invention relates to a device for removing lubricating oil, and more particularly to a device for removing engine oil from an engine.

Problems associated with individuals changing and replacing oil by themselves are manifest. For example, most engine oil drain plugs are screwed into the bottom of the internal combustion engine oil pan or sump pan which necessitates crawling under the automobile and at times jacking-up the automobile to gain access to the drain plug.

When the drain plug is manually removed, the lubricating oil initially spurts out of the drain hole quite quickly, and it is not uncommon for the person's hand(s) to become oil-splattered. Under the above circumstances, when the temperature of the oil is high and it splashes to the person's hand, the person can burn his/her hand. When the drain plug is screwed too strongly by the person, a seal for the drain plug is destroyed. On the other hand, when the drain plug is screwed loosely, the oil leaks out.

SUMMARY OF THE INVENTION

In view of the foregoing, it is an object of the present invention to provide a device for removing lubricating oil from an engine that can remove the oil safely without splashing high temperature lubricating oil on workers when the oil is extracted. It is another object of the present invention to provide a device for removing lubricating oil from an engine which can prevent oil leaking out when the drain plug is unscrewed, or damage to the seal when the plug is screwed too tight and also avoid the problem of a person forgetting to screw it in. It is further object of the present invention to provide a device for removing lubricating oil from an engine which can position a tip end portion of the extraction pipe at a bottom surface of an oil pan when an oil strainer is positioned adjacent to the axis of the oil level dipstick tube.

Moreover, it is still another object of the present invention to provide a device for removing lubricating oil from an engine which allows the replaced dirty oil to be inspected by the customers easily. It is still a further object of the present invention to provide a device for removing lubricating oil from an engine whereby almost all of the lubricating oil from the engine oil pan or sump can be extracted.

The above objectives and novel features of the invention are further described in the following detailed description and the accompanying drawings.

It is to be expressly understood, however, that the drawings are for the purpose of illustration only and are not intended as a definition of the limits of the invention.

DETAILED DESCRIPTION OF THE PREFERRED EMBODIMENTS

Figure 1:
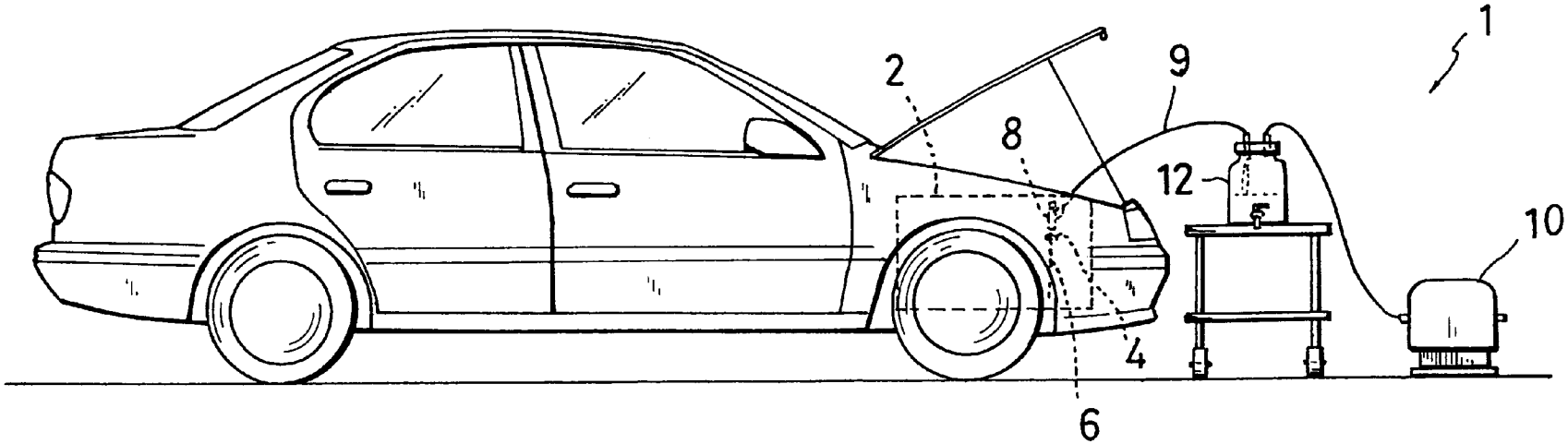
FIG. 1 is a view showing a first embodiment of the present invention in use.
Figure 2:
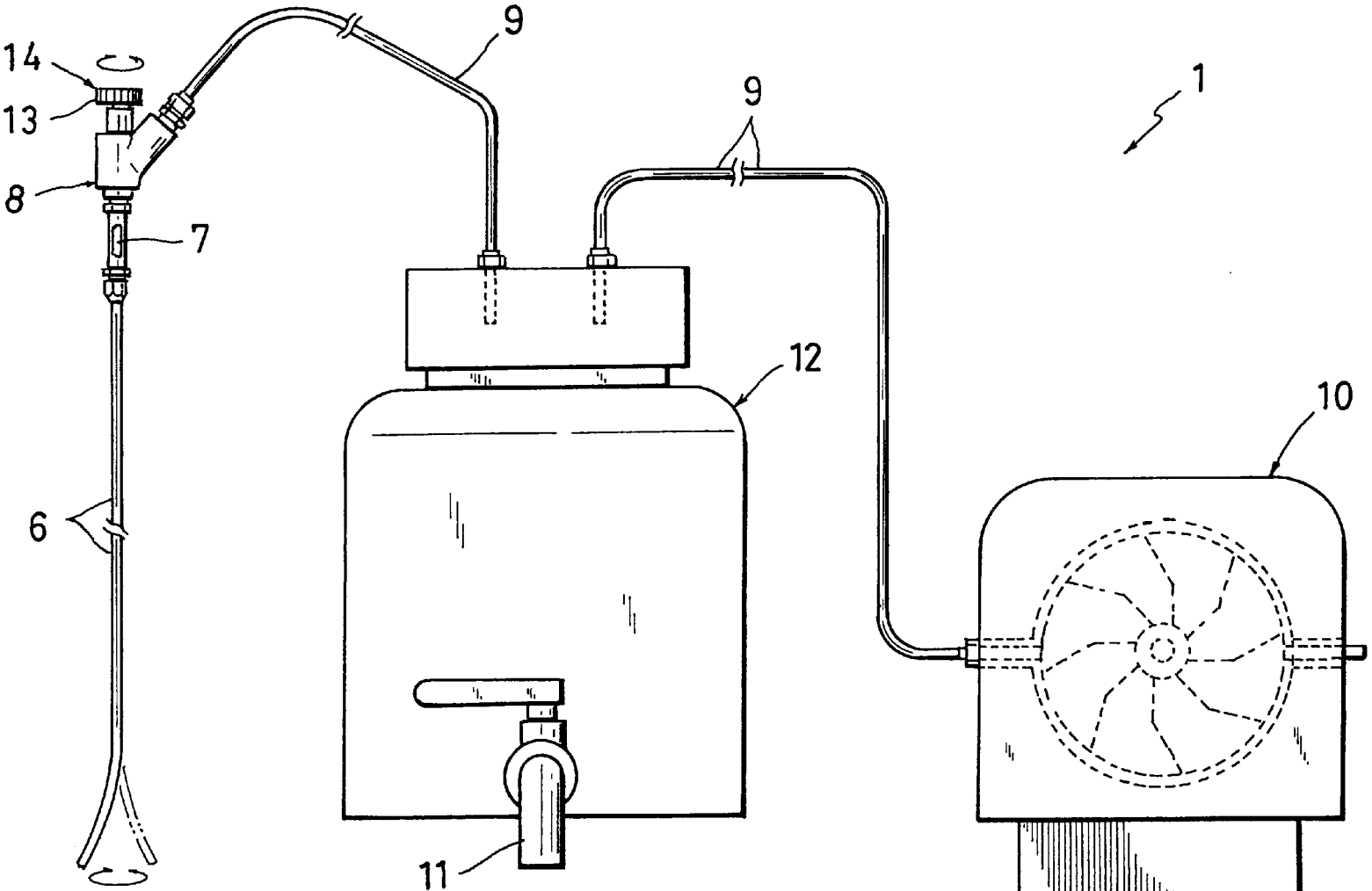
FIG. 2 is a front view.
Figure 3:
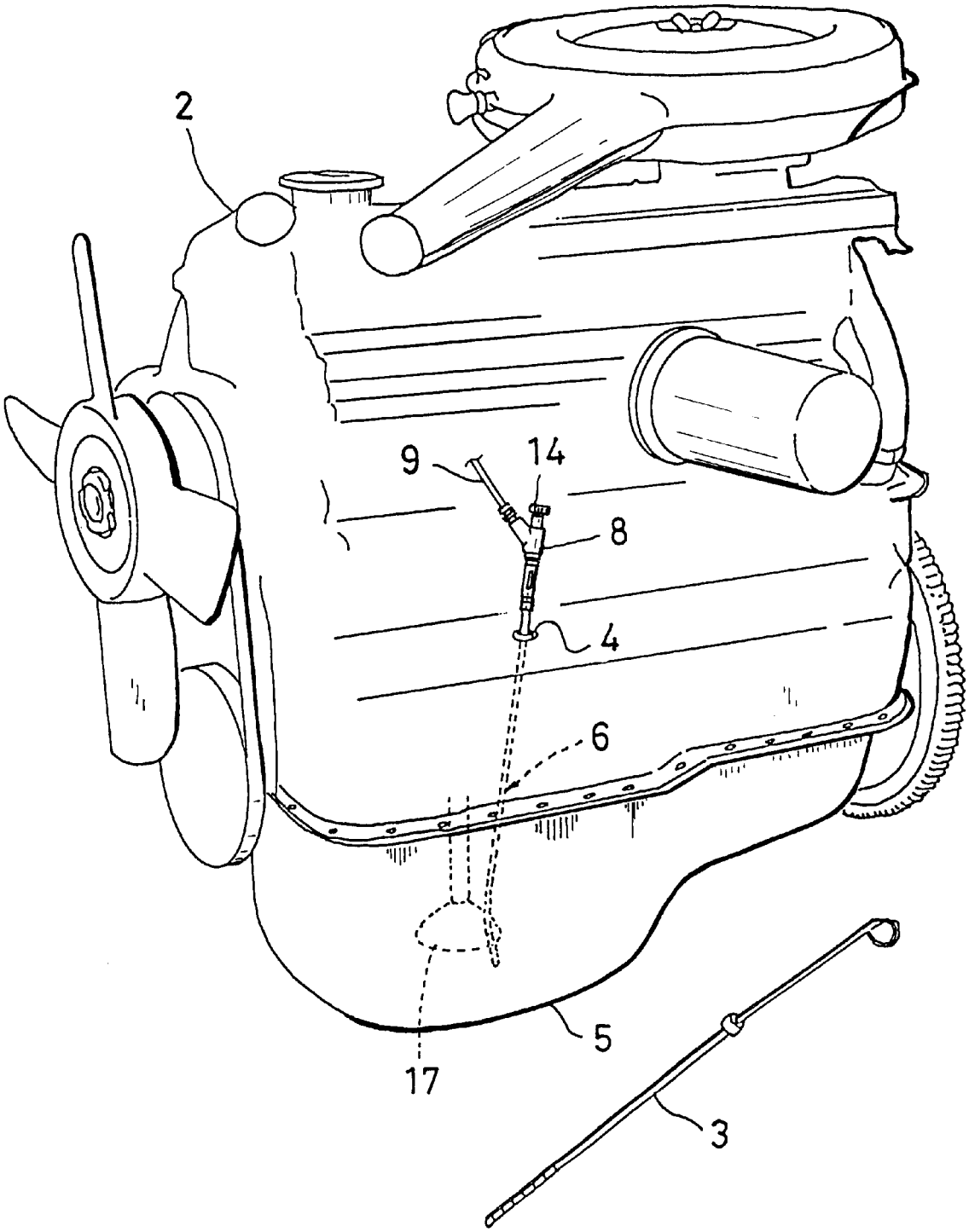
FIG. 3 is a view showing the way in which an extraction pipe is extended into an oil level dipstick tube.
Figure 4:
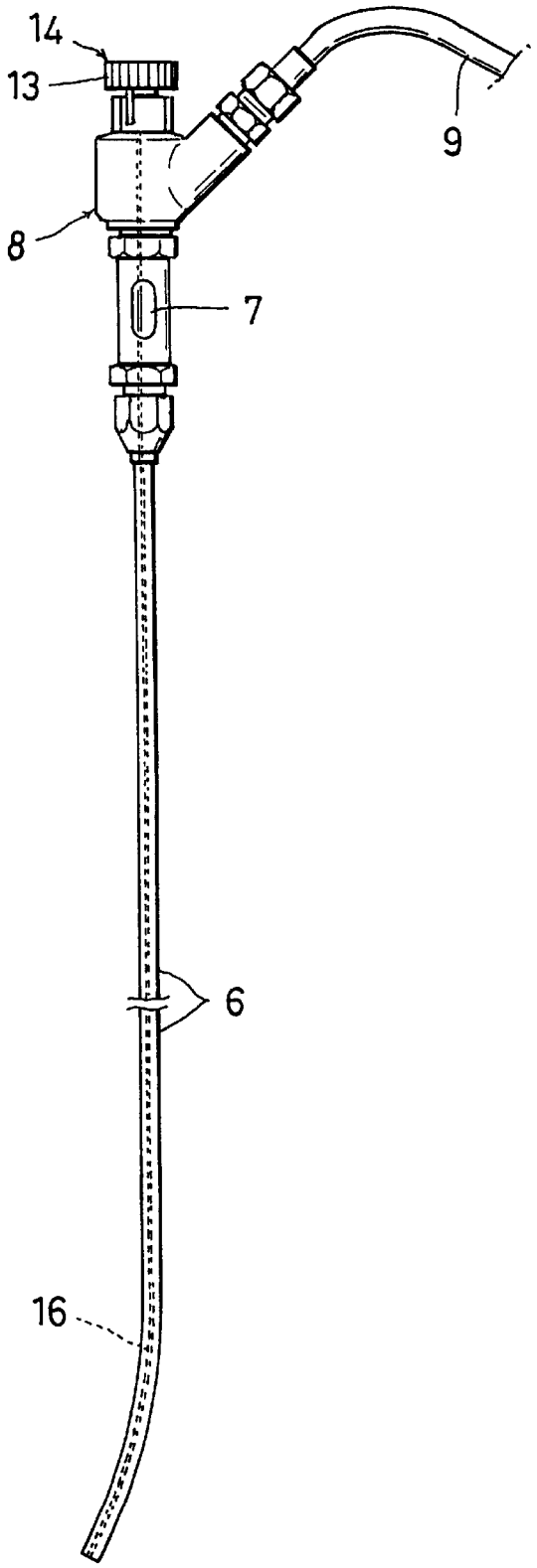
FIG. 4 is a view of an extraction pipe of the first embodiment of the present invention.
Figure 5:
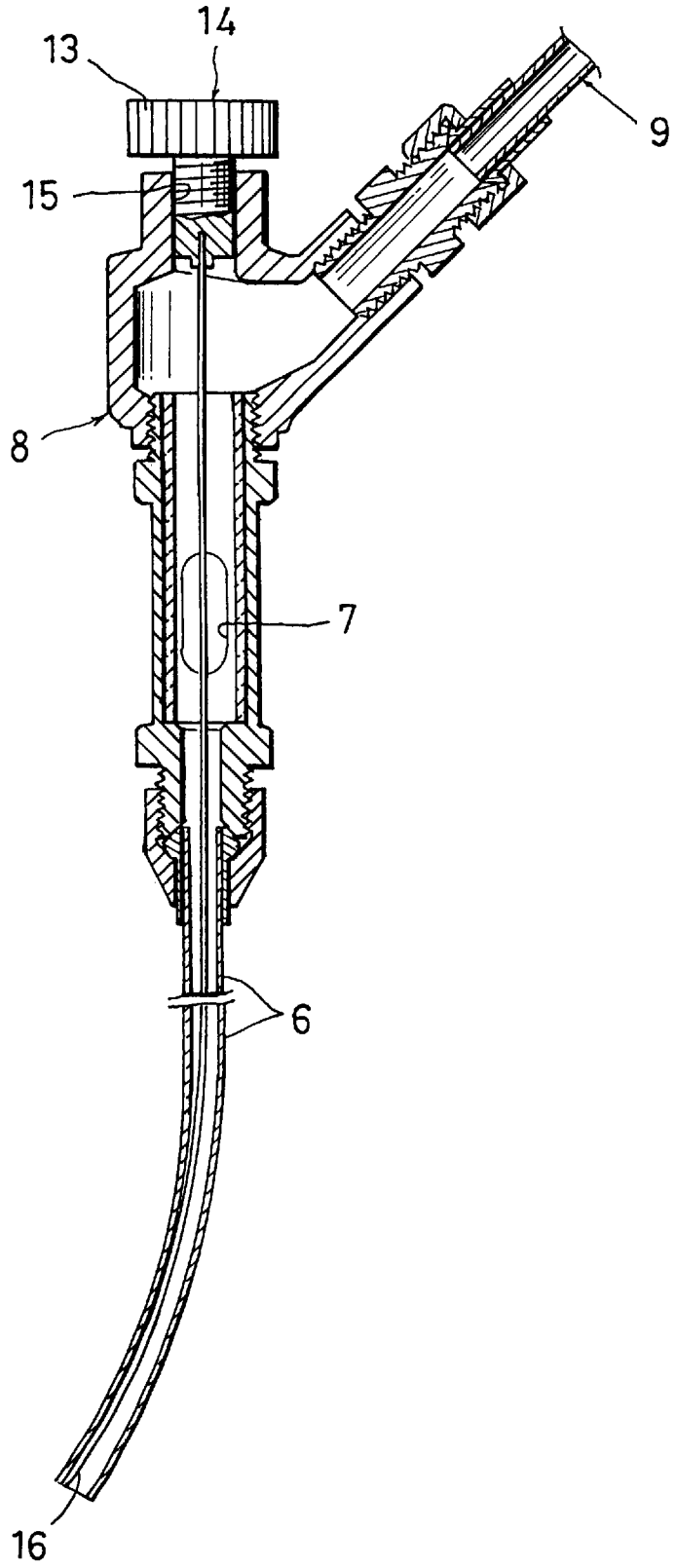
FIG. 5 is an expanded sectional view showing the essential features of an extraction pipe of the first embodiment of the present invention.
Figure 6:
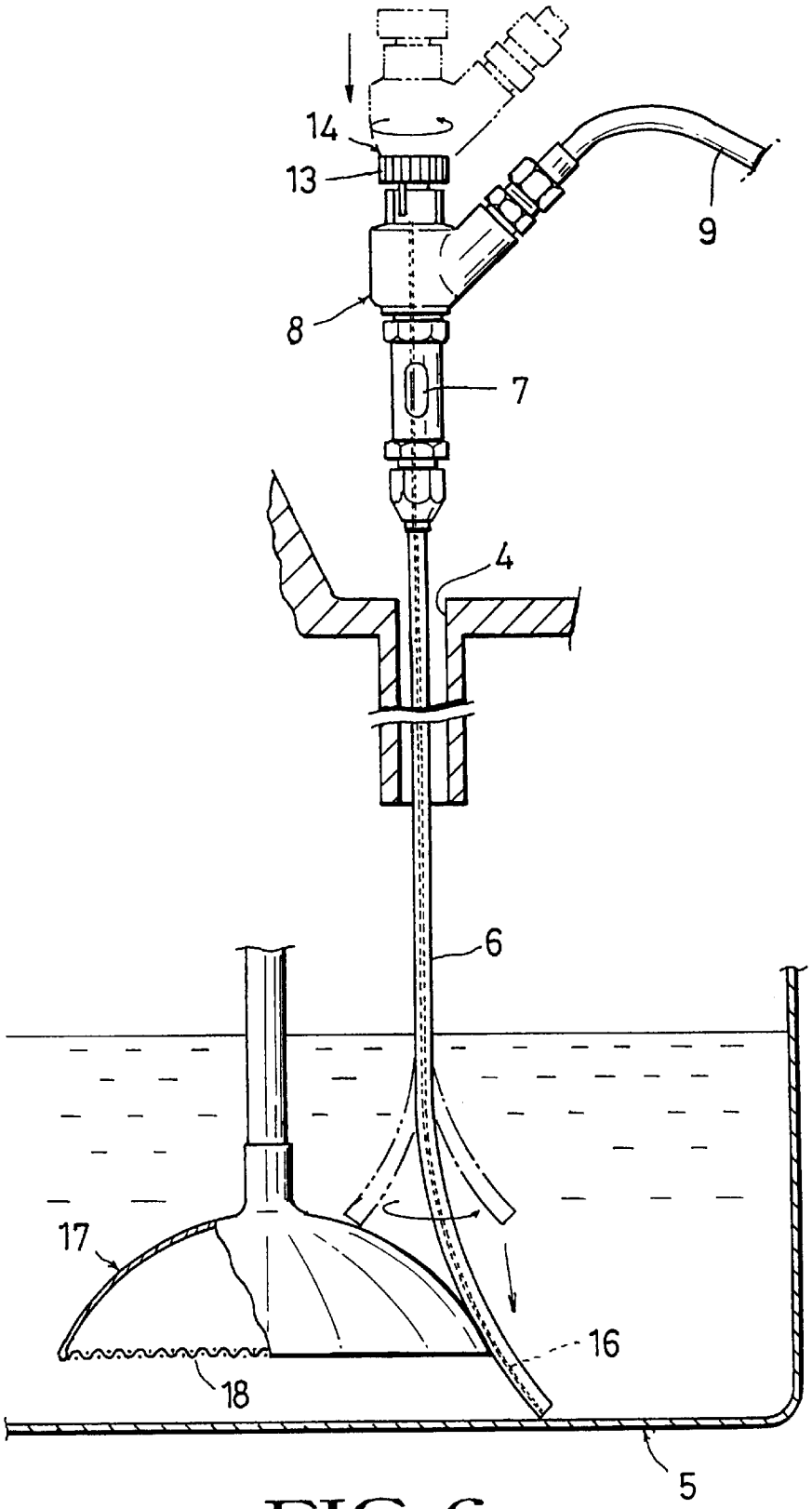
FIG. 6 is a view of a pipe bending means of the first embodiment of the present invention.

Preferred embodiments of the present invention are described in more detail below and are shown in the accompanying drawings.

An understanding of the present invention may be best gained by reference FIGS. 1 to 6. Referring to FIGS. 1 to 6, numeral 1 shows a device for removing the lubricating oil from an engine, which is composed of an extraction pipe 6, a connector 8, a suction pump 10, a reservoir 12 and a means for bending extraction pipe 14. The extraction pipe 6 is inserted through an opening 4 of an oil level dipstick tube associated with the engine 2 into a bottom of the oil pan 5 until an end of the extraction pipe 6 contacts the bottom of the oil pan 5 or sump. The connector 8 is connected to a back end portion of the extraction pipe 6, and has an inspection window capable of visually checking the color of the oil extracted therethrough from the outside thereof. This connector 8 is curved. The suction pump 10 is connected to the connector 8 via the connection pipe 9 and pumps the lubricating oil from the engine sump/oil pan 5 of the engine 2. The reservoir 12 has an exhaust cock 11. The pipe bending means 14 can bend a tip end portion of the extraction pipe 6 by controlling a control 13 provided at the connector 8.

The pipe bending means 14 is composed of a control 13 and a wire 16. The control 13 is screwed rotatably onto an opening defined by a threaded hole 15 provided at a top of the connector 8. The wire 16 includes one end portion and another end portion. One end portion of the wire 16 is fixed and associated with the control 13. Another end portion of the wire 16 passes into the extraction pipe 6 so as to position it at the tip end portion of the extraction pipe 6. Moreover, the tip end portion of the wire 16 is bent.

In accordance with this invention, the device 1 is utilized in association with the engine 2 by withdrawing the an oil level dipstick 3 from the oil level dipstick tube and inserting the device in the end of the dipstick tube until the end of the extraction pipe 6 contacts the bottom of the oil pan 5.

During the insertion of the device when the tip end portion of the extraction pipe 6 contacts the filter 18 of the oil strainer 17, the tip end portion of the extraction pipe 6 is bent in operation relation to the wire 16 by rotatably controlling the control 13 of the pipe bending means 14, and it can avoid the filter 18 of the oil strainer 17 and position itself at the bottom surface of the oil pan 5.

After the end of the extraction pipe 6 bottoms at the bottom of the oil pan 5, the lubricating oil of the oil pan 5 can be drawn through the extraction pipe 6, connector 8 and connection pipe 9 from the oil pan 5 by the suction pump. After that, the oil flowing through the connection pipe 9 can be deposited into the reservoir 12.

During extraction of the oil, the operator and customer can inspect the color of the oil flowing through the inspection window 7 of the connector 8.

Other embodiments of the present invention arc described below and in FIGS. 7 to 18.

Figure 7:
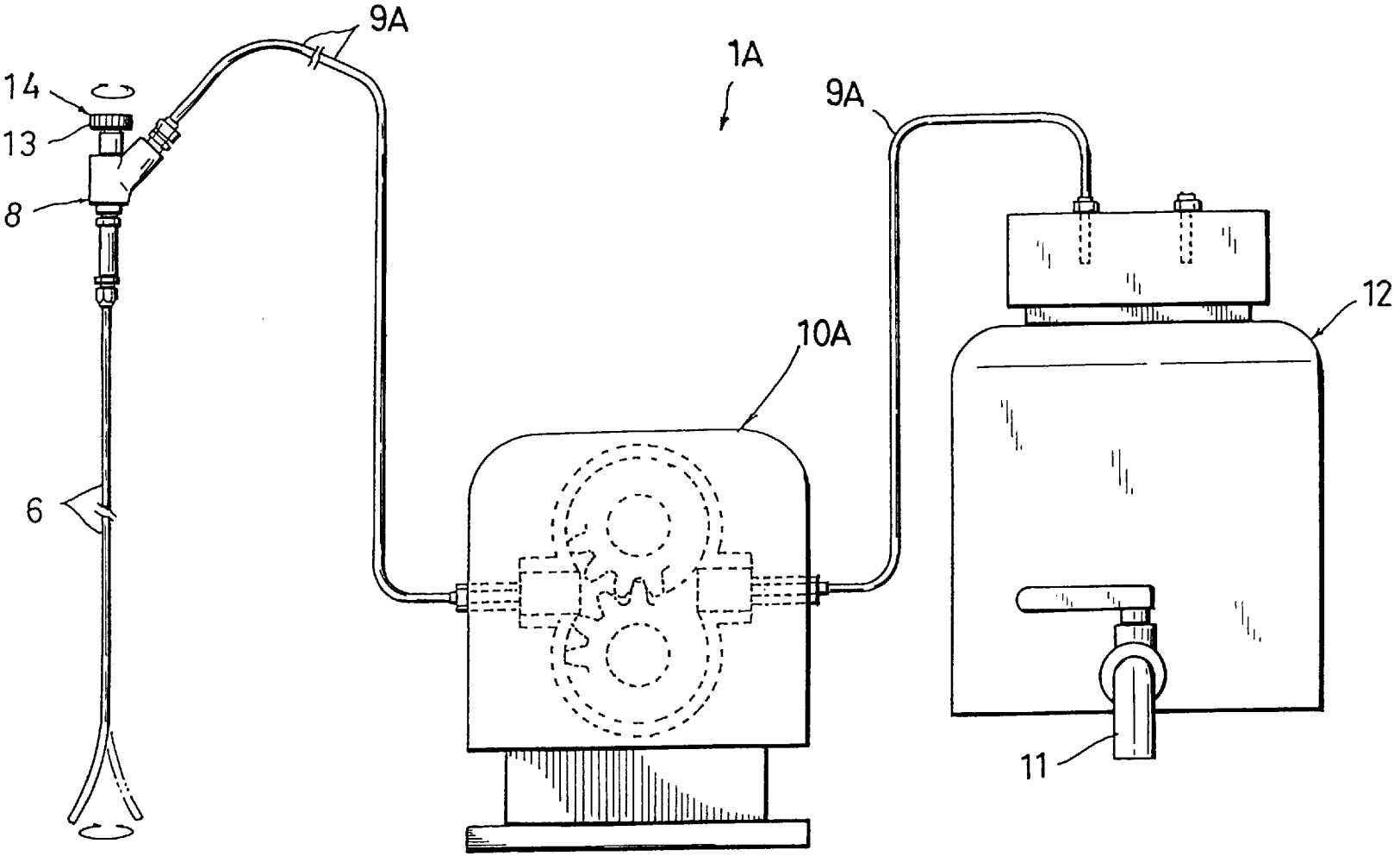
FIG. 7 is a front view showing a second embodiment of the present invention.
Figure 8:
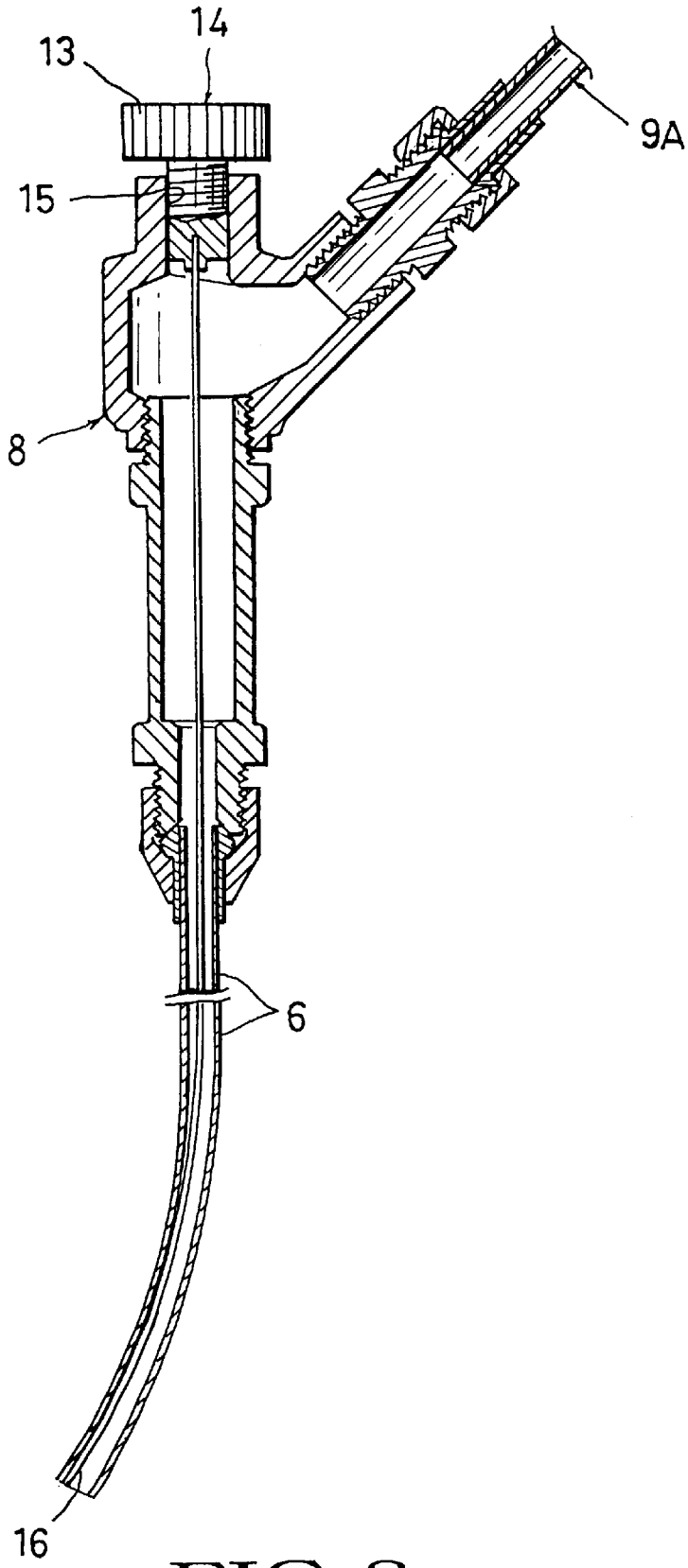
FIG. 8 is a view of an extraction pipe of the second embodiment of the present invention.

A second embodiment of the present invention is shown in FIGS. 7 and 8. It is distinguished from the first embodiment by the fact that a connector 8 does not have an inspection window. Also a connection pipe 9 is replaced by another connection pipe 9A which is formed of transparent material. The reservoir 12 is located downstream of a gear-suction pump 10A. A device for removing lubricating oil from an engine 1A formed in this way according to the second embodiment will provide the same effects as the first embodiment.

Figure 9:
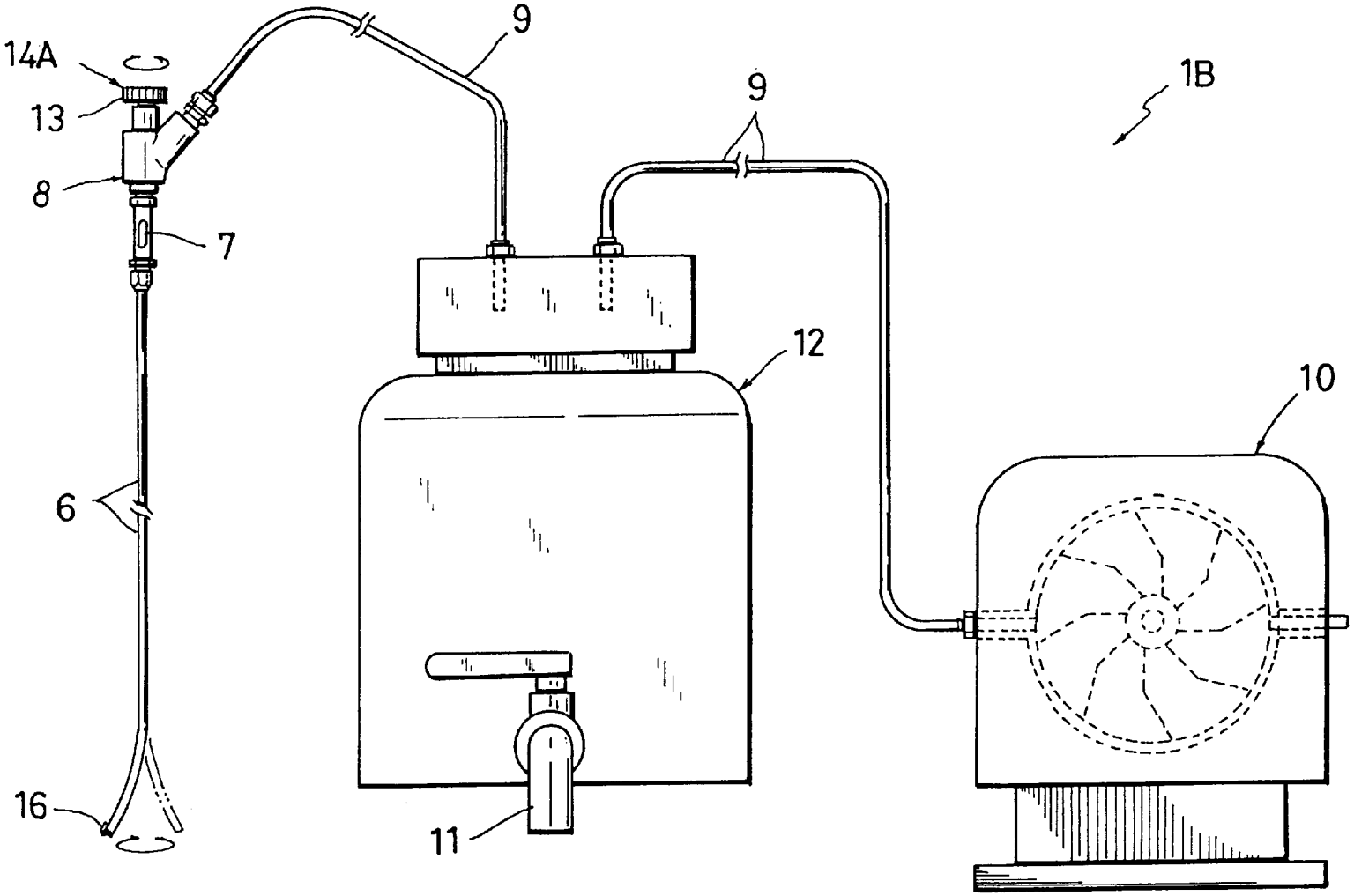
FIG. 9 is a front view showing a third embodiment of the present invention.
Figure 10:
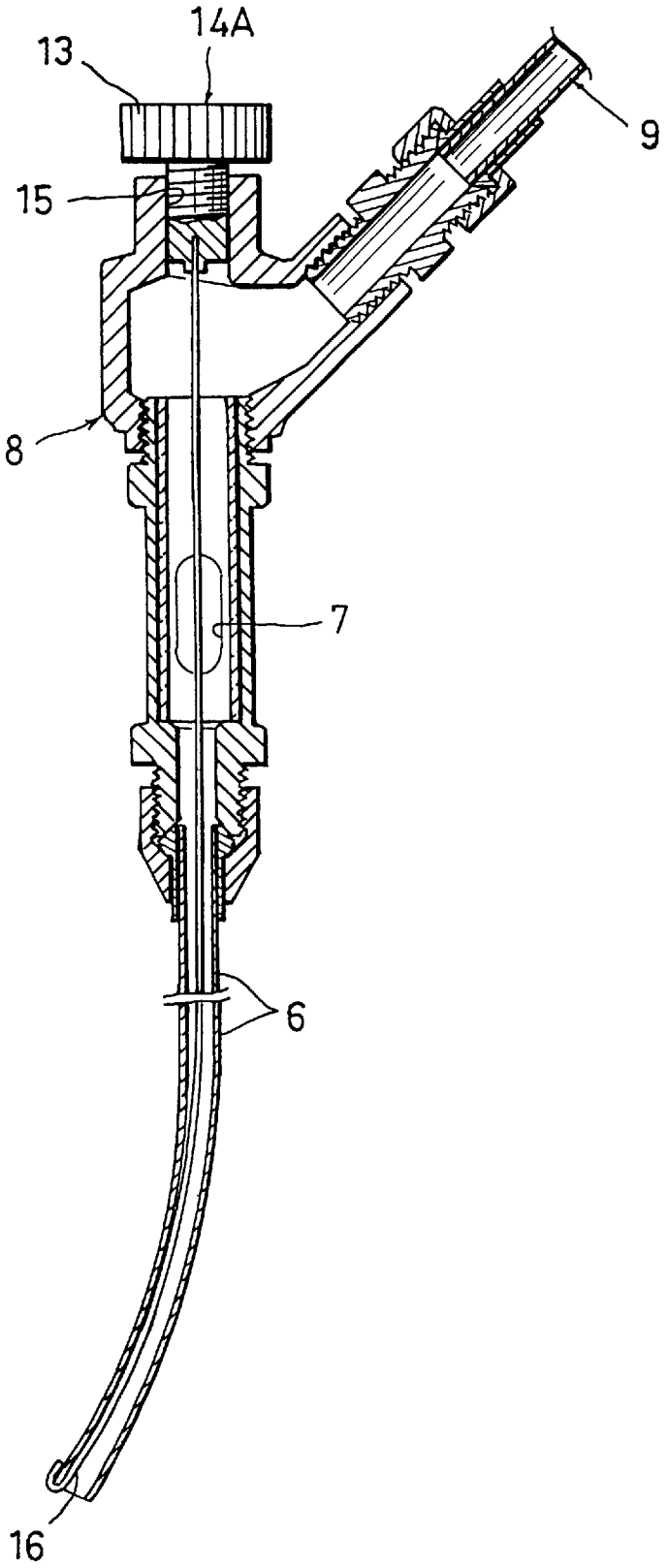
FIG. 10 is a view of an extraction pipe of the third embodiment of the present invention.

A third embodiment of the present invention is shown in FIGS. 9 and 10. It is distinguished from the first embodiment by the fact that a pipe bending means 14A is provided so as to curve the lower portion of the extraction pipe 6. The tip end portion of the wire 16 is bent in the shape of the letter "U", the U-letter-shaped end portion thereof being stopped by connecting to an edge portion of the tip end portion of the extraction pipe 6. A device for removing lubricating oil from an engine 1B with the bending means 14A formed in this way according to the third embodiment will provide the same effects as the first embodiment.

Figure 11:
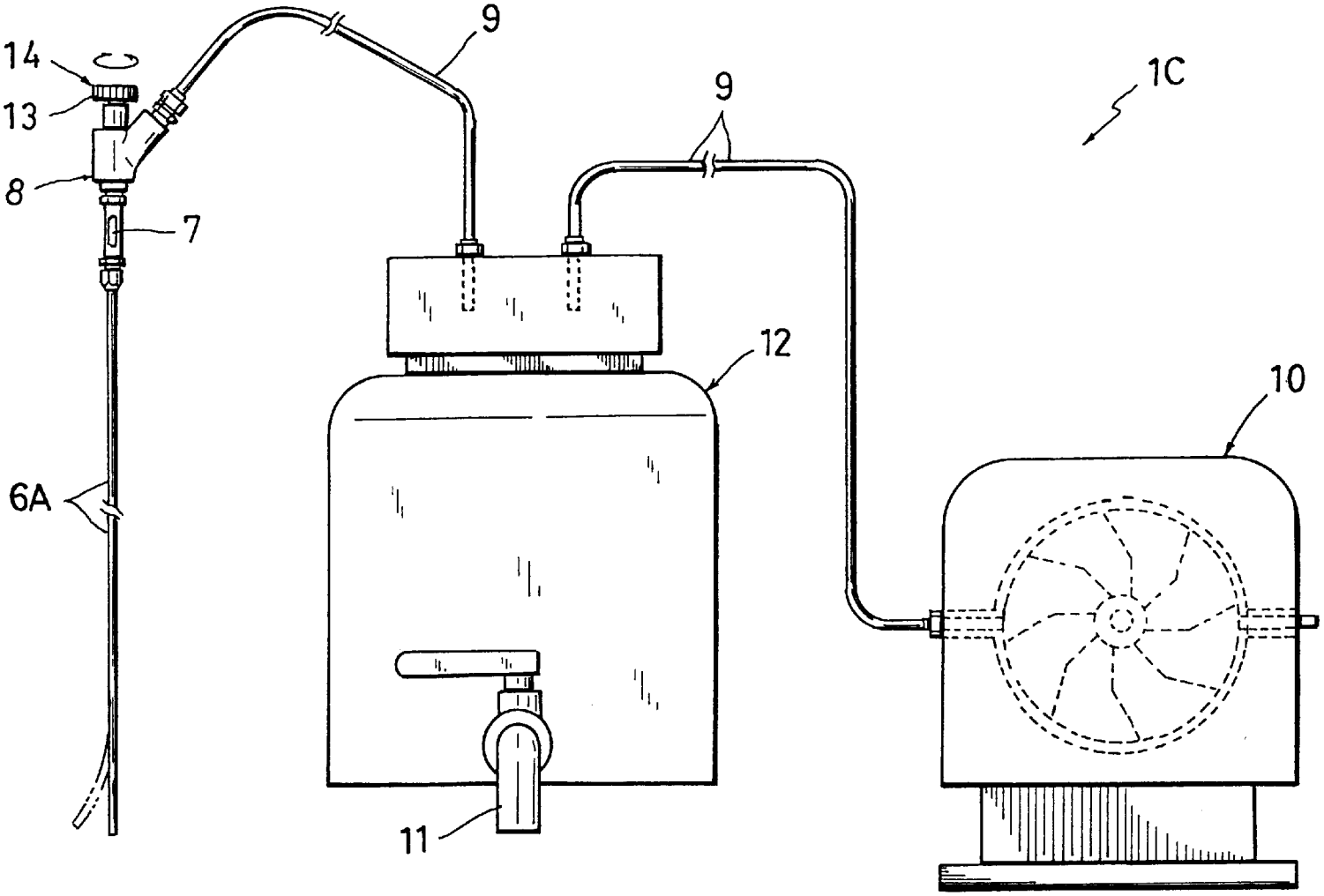
FIG. 11 is a front view showing a fourth embodiment of the present invention.
Figure 12:
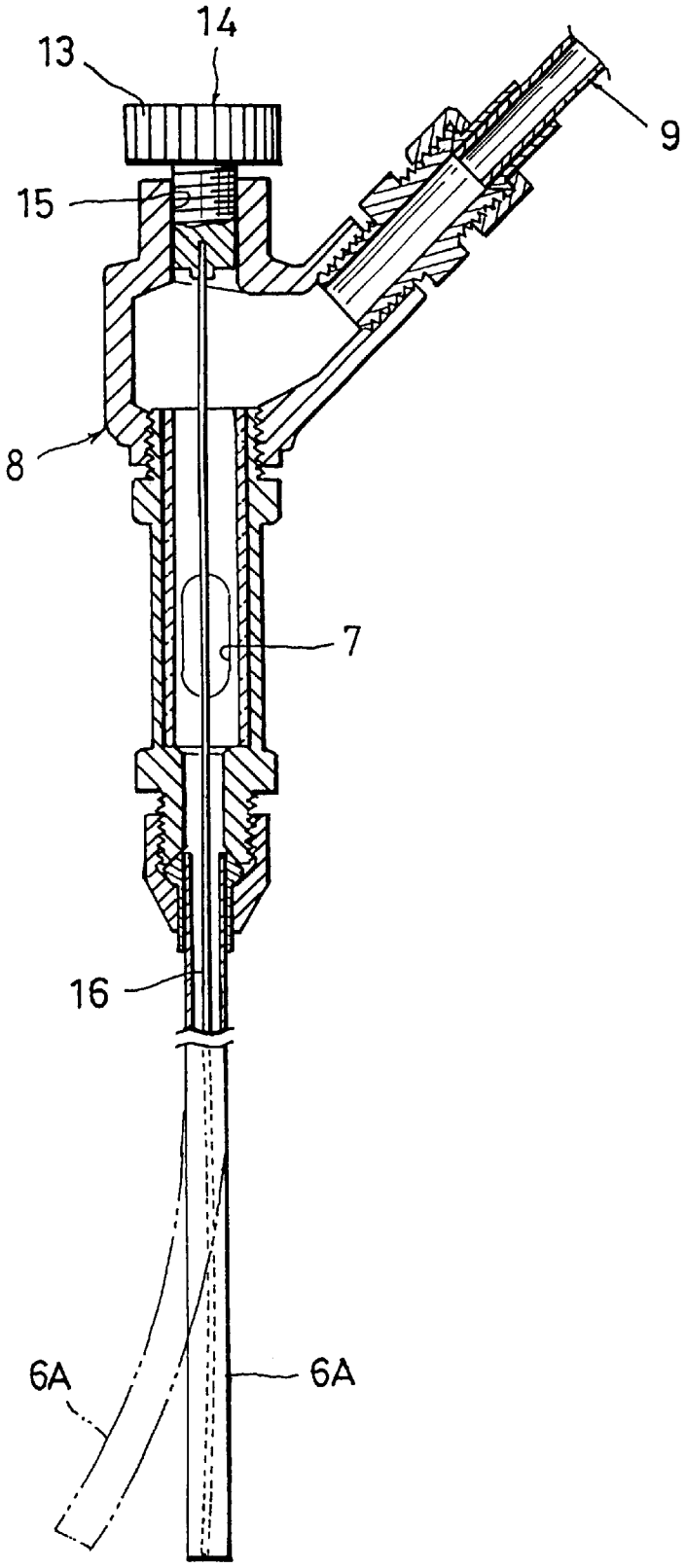
FIG. 12 is a view of an extraction pipe of the fourth embodiment of the present invention.

A fourth embodiment of the present invention is shown in FIGS. 11 and 12. It is distinguished from the first embodiment by the fact that the extraction pipe 6 is replaced by another extraction pipe 6A. The extraction pipe 6A, made of shape-memory material such as shape-memory alloy, shape-memory polymer or the like, includes the tip end portion, the tip end portion thereof being originally shaped in an arc and being able to return to that shape. The pipe is bent by the heat and temperature of the engine oil. A device for removing lubricating oil from an engine 1C with the extraction pipe 6A formed in this way according to the fourth embodiment will provide the same effects as the first embodiment.

In addition, the pipe bending means having just the extraction pipe 6A may be used in the other embodiments of the present invention.

Figure 13:
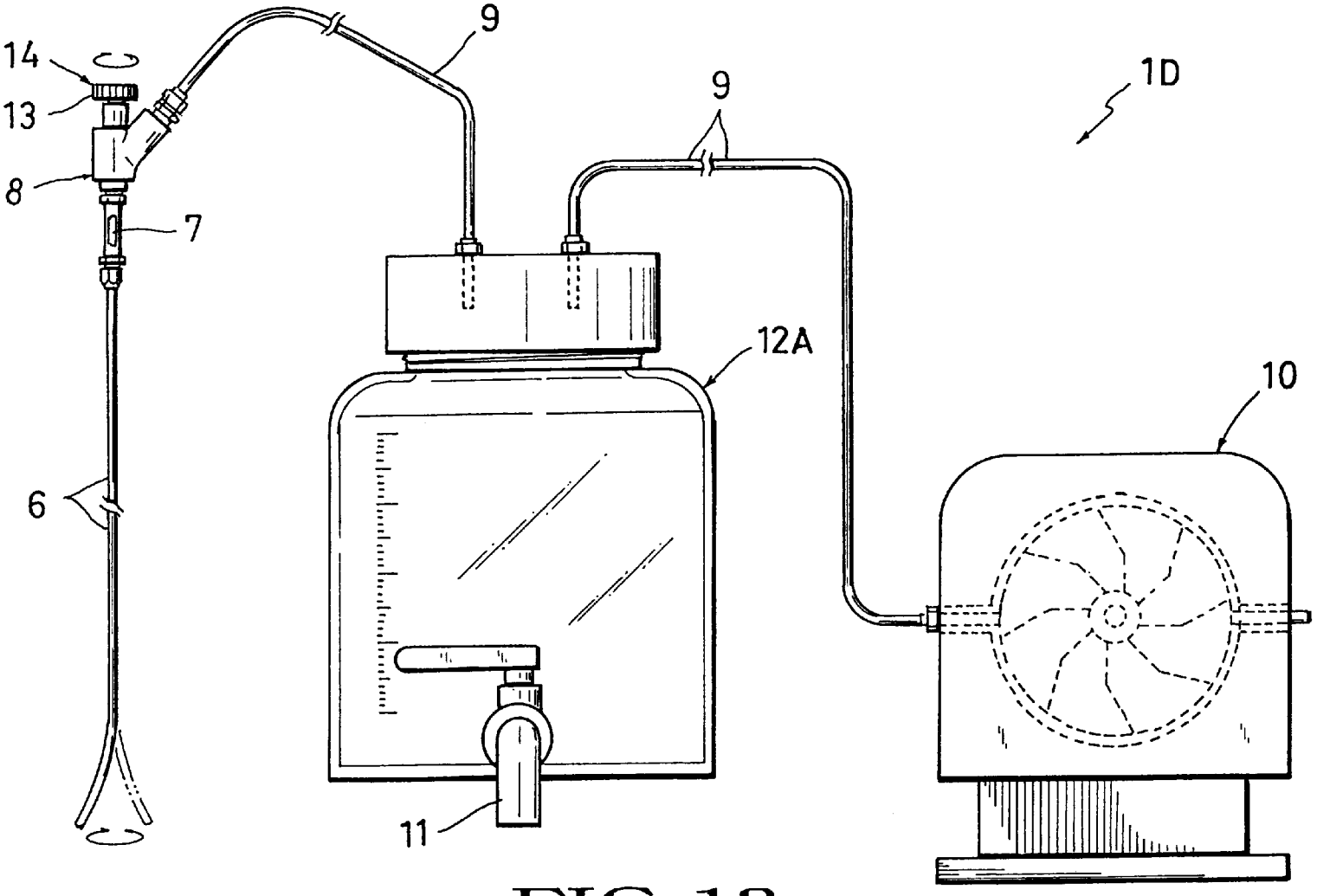
FIG. 13 is a front view showing a fifth embodiment of the present invention.
Figure 14:
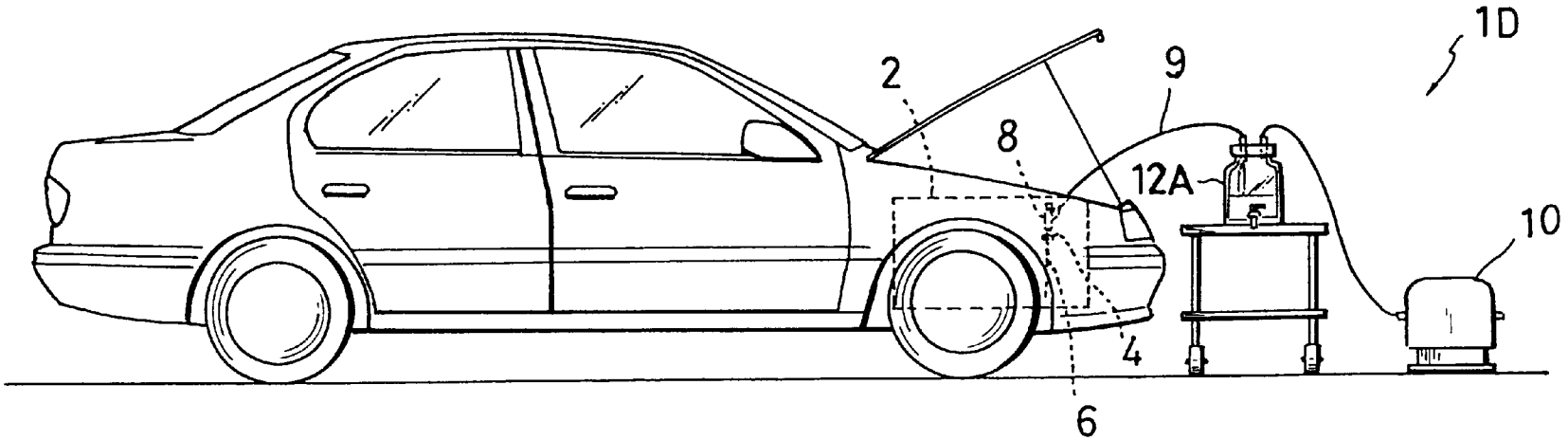
FIG. 14 is a view showing the fifth embodiment of the present invention in use.

A fifth embodiment of the present invention is shown in FIGS. 13 and 14. It is distinguished from the first embodiment by the fact that the reservoir 12 is replaced by another reservoir 12 A and is formed of transparent material. A device for removing lubricating oil from an engine 1C with the reservoir 12A formed in this way according to the fifth embodiment will provide the same effects as the first embodiment.

Figure 15:
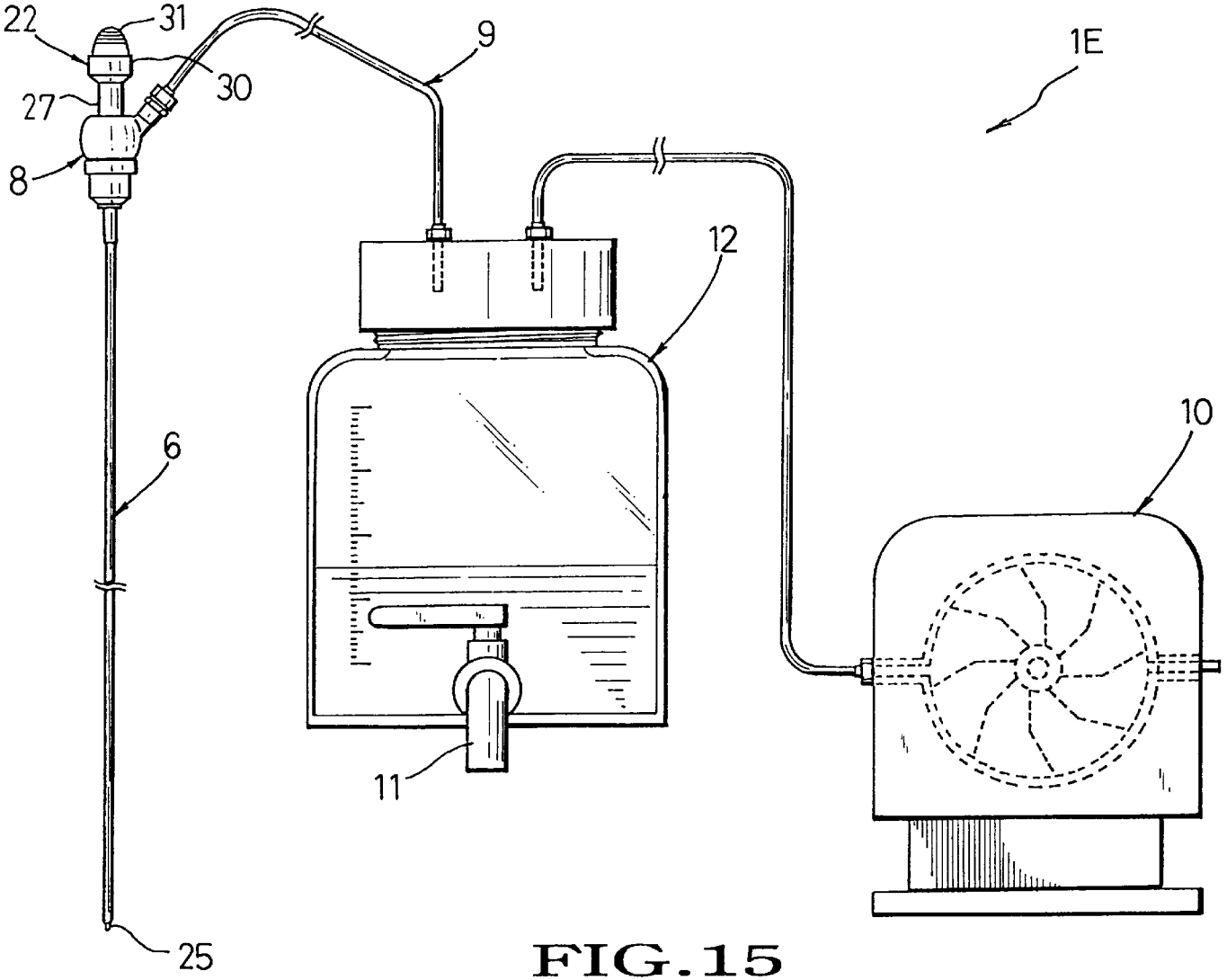
FIG. 15 is a front view showing a sixth embodiment of the present invention.
Figure 16:
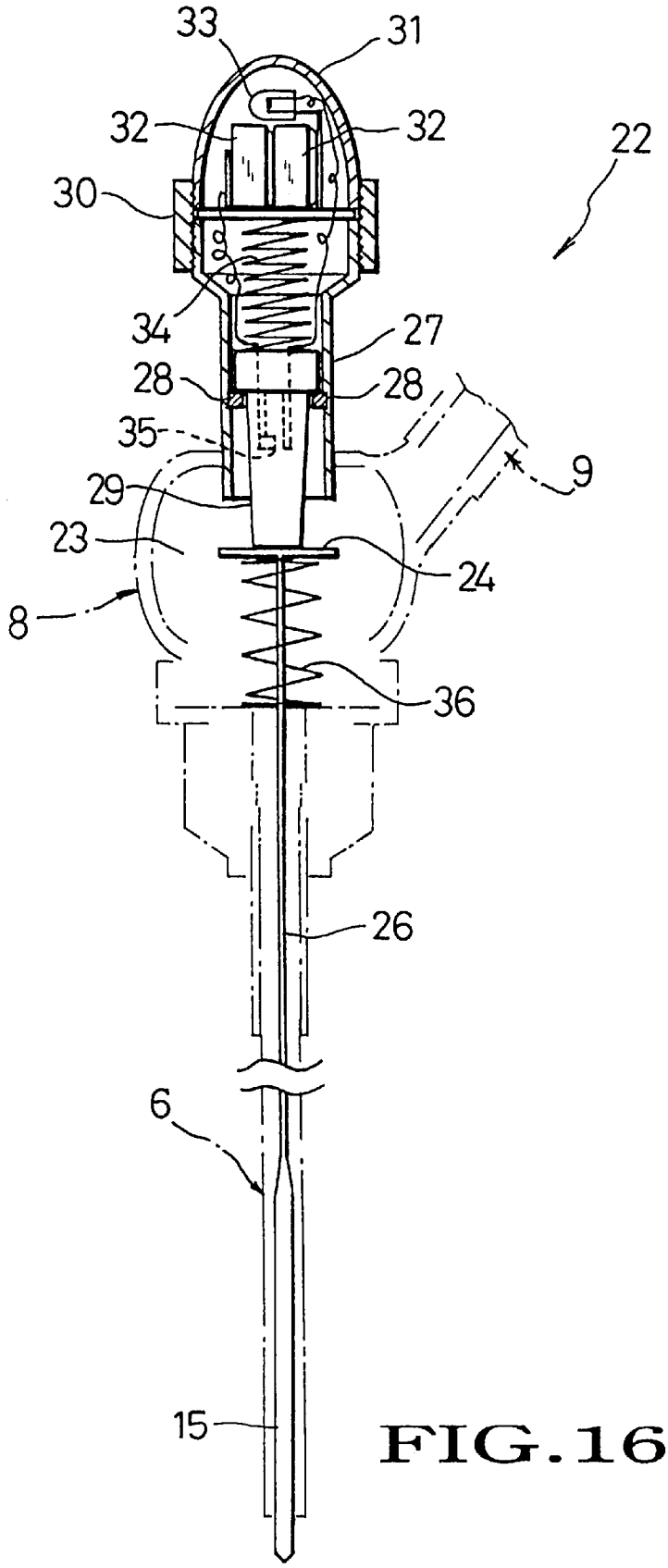
FIG. 16 is a view of an indicator of the sixth embodiment of the present invention.
Figure 17:
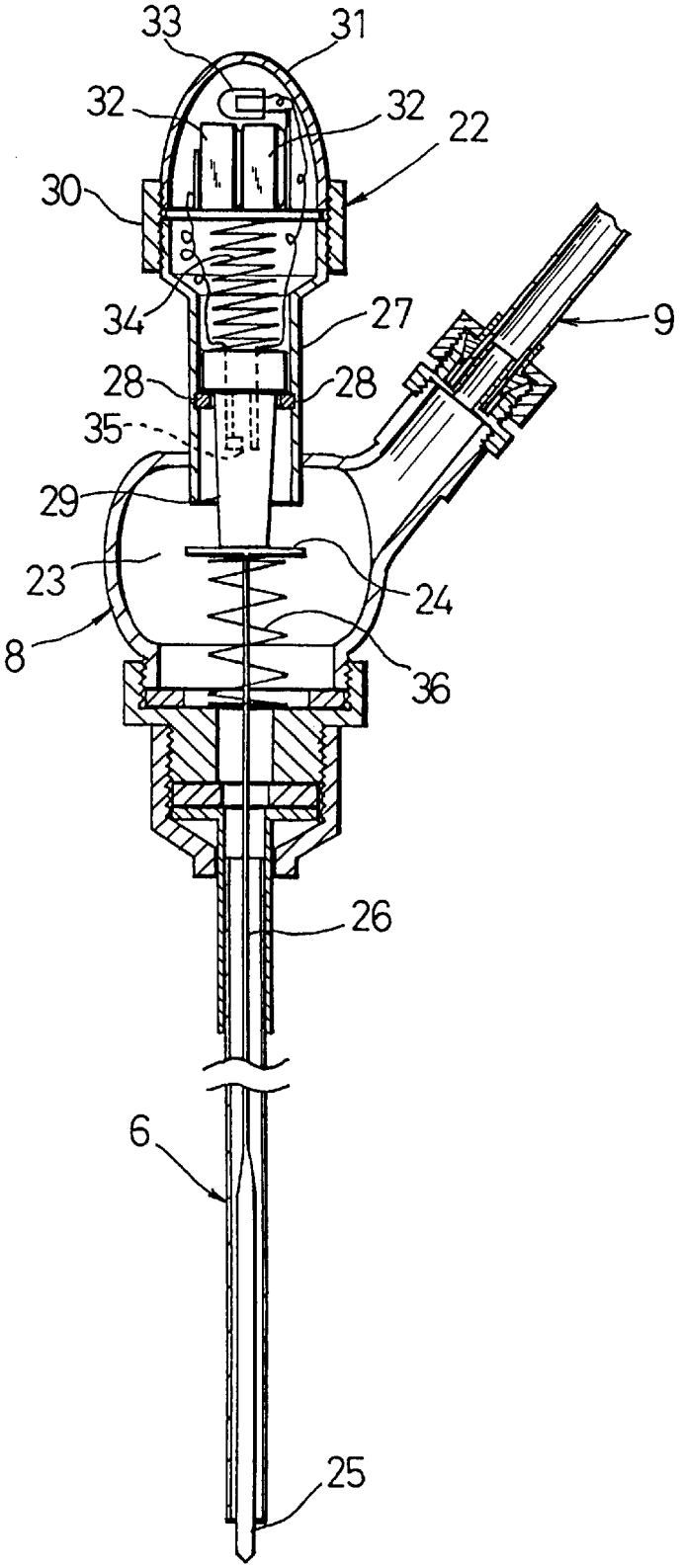
FIG. 17 is an expanded sectional view showing the essential features of the sixth embodiment of the present invention.
Figure 18:
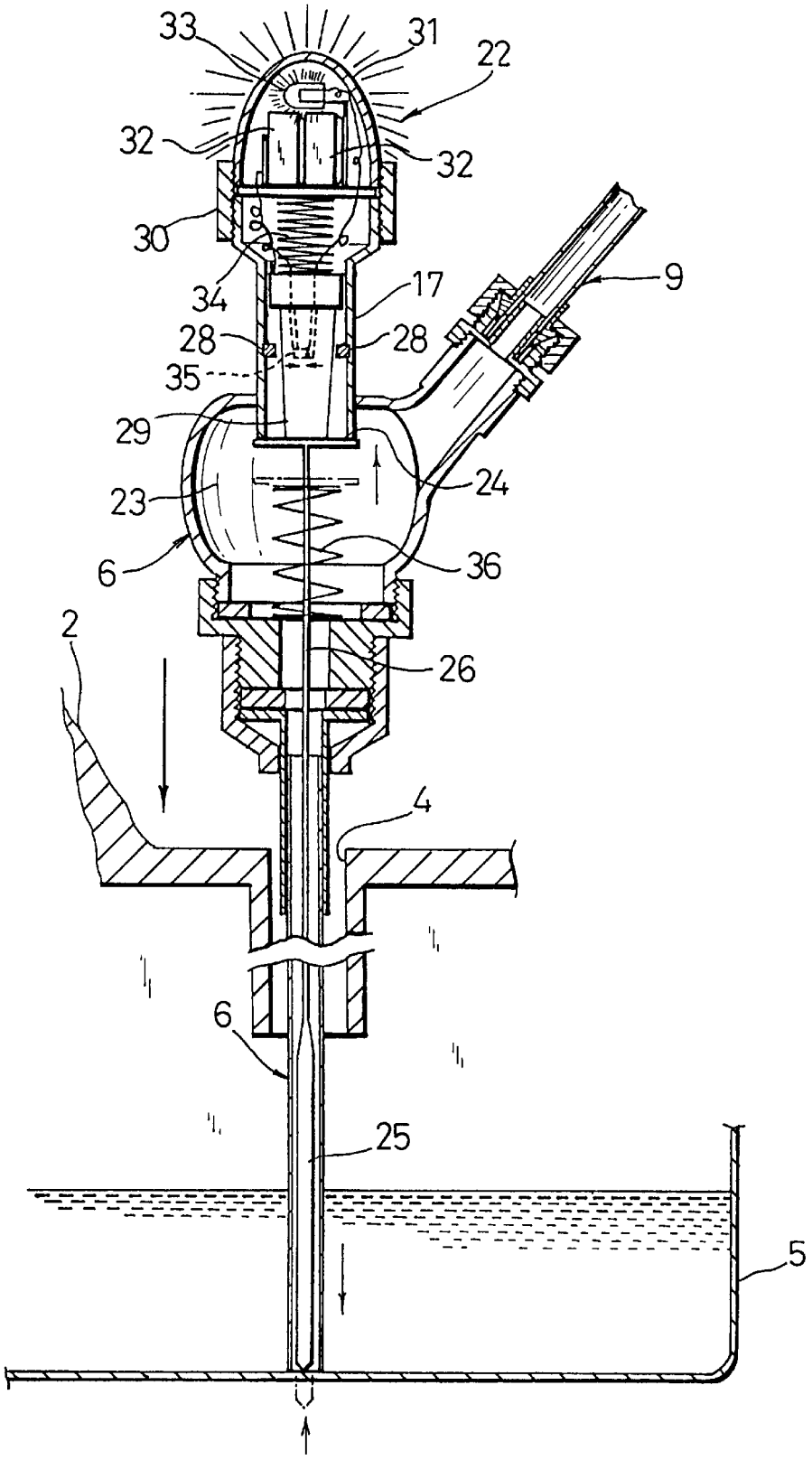
FIG. 18 is a view of an indicator of the sixth embodiment of the present invention in operation.

A sixth embodiment of the present invention is shown in FIGS. 15 and 18. It is distinguished from the first embodiment by the fact that an indicator 22 is mounted to the extraction pipe 6 and can inform the operator that the tip end portion of the extraction pipe 6 contacts a bottom surface of the oil pan 5. As shown in FIGS. 16 to 18, the indicator 22 is composed of a rod 26, a guide tube 27, a stopper 28, a slidable moving object 29, a lamp cover 31, a battery 32, a lamp 33, a spring 34, a switch 35 and a rod spring 36.

The rod 26 includes one end portion defining a stopper segment 24 positioned within a passage 23 formed into the connector 8 and another end portion provided successively and fixedly shape-memory alloy 25, formed in a shape of a board, passes along the inside wall of the extraction pipe 6 and protrudes outwardly from the tip portion having the opening of the extraction pipe 6.

The guide tube 27 is provided at the connector 8 such that the axis of the guide tube 27 is directed in the same direction as the axis along which the end portion of the rod 26 moves.

The stopper 28 is defined by a ring-shaped magnet and is provided fixedly on an inner wall surface adjacent the center portion of the guide tube 27.

The slidable moving object 29 is provided slidably in the guide tube 27 and moves the stopper segment 24 of the rod 26 and is stopped by the stopper 28. In addition, the tip end portion of the slidable moving object 29 can protrude outwardly at a prescribed length from the tip portion of the extraction pipe 6.

The lamp cover 31 is provided on the upper portion of the guide tube 27 by a nut 30 so as to cover an upper end portion of the guide tube 27.

The lamp 33 defines an indicator and is installed in the lamp cover 31.

Moreover, the battery 32 is installed into the lamp cover 31 and is mounted to a base plate.

The spring 34 is installed in the guide tube 27 and is positioned between the moving object and the base plate so as to contact the slidable moving object 29 with the stopper 28.

The switch 35 includes one terminal and another terminal. The one terminal of the switch 35 is connected with the battery 32, such that the switch 35 is placed in its "ON" position by the stopper 28. The slidable moving object 29 installed within the guide tube 27 moves slidably and spring 34 acts oppositely upon the rod 26. Another terminal of the switch 35 is connected with the lamp 33.

The rod spring 36 is installed inside the passage 23 of the connector 8 such that the stopper segment 24 of the rod 26 always keep in touch with the moving object 29. The strength of the rod spring 36 is weaker than that of the spring 34.

A device for removing lubricating oil from an engine 1E with the indicator 22 mounted to the extraction pipe 6 according to the sixth embodiment will provide the same effects as the first embodiment. The operator can understand certainly through the indicator 22 that the tip end portion of the extraction pipe 6 contacts the bottom surface of the oil pan 5 or engine sump.

Moreover, the rod spring 36 of this embodiment of the present invention may be formed from shape-memory alloy. In this case, the end of the extraction pipe may contact the bottom of the oil pan and when the spring contracts, and the protruded tip end is of the wire is withdrawn inside the extraction pipe when the hot oil passes through inside the extraction pipe.

Furthermore, regarding each of the embodiments of the present invention, the wire 16 used in the pipe bending means 14 and 14A may be made of shape-memory alloy, straight-memory line, shape-memory polymer or the like. In this case, the extraction pipe may be maintained its original shape constantly after use.

As set forth above, the advantages of the invention are as follows:

(1) A device for removing lubricating oil from an engine includes an extraction pipe extending downwardly in an oil level dipstick tube, the extraction pipe having a tip end portion proximate a bottom of an oil pan of the engine; a suction pump device selectively provided with either the extraction pipe integrally or with a connection pipe connected to the extraction pipe, creating a suction condition effective to induce flow of oil via either the extraction pipe or connection pipe; and an associated reservoir selectively provided upstream or downstream of the suction pump device, depositing oil therein whereby the extraction pipe is inserted downwardly into the oil level dipstick tube and into the engine oil in the oil pan or engine sump of the engine.

Therefore, the operator can drain the lubricating oil from the engine oil pan without removing the drain plug in a short time. It can prevent the splashing of oil at a high temperature. Also it can prevent the leakage of lubricating oil out of the drain hole.

(2) As discussed above, the device is simple such that everyone can use it, and it is possible to manufacture it at a relatively low cost.

(3) As discussed above, when the tip end portion of the extraction pipe touches the filter of the oil strainer, the tip end portion of the extraction pipe is acted on by the wire which is controllably rotated by controlling the control of the pipe bending means, and it can avoid the filter of the oil strainer and position itself at the bottom surface of the oil pan.

(4) The device includes an inspection window provided between the back end of the extraction pipe and suction pump and a reservoir formed of transparent material or a portion of which is transparent so that the operator and customer can check the color of the extracted oil.

Therefore, the exchange of lubricating oil of an engine can be conducted after the customer sees the color of the oil. In addition, the operator and customer can improve their business relationship with each other.

What is claimed is:

1. A device for removing lubricating oil from an engine comprising:

an extraction pipe extendable downwardly in an oil level dipstick tube, said extraction pipe having a tip end portion proximate a bottom of an oil reservoir of the engine and a pipe bending member provided at said extraction pipe for bending a tip end portion of said extraction pipe by controlling a control provided at a back end portion of the extraction pipe;

a suction pump device provided with said extraction pipe creating a suction condition effective to induce flow of oil via said extraction pipe; and an associated reservoir located at one of a position upstream of said suction pump device and a position downstream of said suction pump device to receive said flow of oil therein from said extraction pipe.

2. A device for removing lubricating oil from an engine according to claim 1 wherein said pipe bending member comprises a shape memory polymer.

3. A device for removing lubricating oil from an engine comprising:

an extraction pipe extendable downwardly in an oil level dipstick tube, said extraction pipe having a tip end portion proximate a bottom of an oil reservoir of the engine;

a suction pump device provided with said extraction pipe creating a suction condition effective to induce flow of oil via said extraction pipe;

an associated reservoir located at one of a position upstream of said suction pump device and a position downstream of said suction pump device to receive said flow of oil therein from said extraction pipe; and an indicator mounted at said extraction pipe for indicating a condition that said tip end portion of said extraction pipe contacts a bottom surface of the oil reservoir of the engine.

* * * * *